US006057530A

United States Patent [19]

Gurevich

[11] Patent Number: 6,057,530

[45] Date of Patent: May 2, 2000

[54] FABRIC HEATING ELEMENT AND METHOD OF MANUFACTURE

[75] Inventor: Arthur Gurevich, Wilmette, Ill.

[73] Assignee: Thermosoft International Corporation, Wilmette, Ill.

[21] Appl. No.: 08/705,527

[22] Filed: Aug. 29, 1996

[51] Int. Cl.[7] ..... H05B 3/34; H05B 3/00

[52] U.S. Cl. ..... 219/529; 29/611

[58] Field of Search ..... 219/528, 529, 219/543, 545, 548, 549, 211, 212; 29/611, 620

[56] References Cited

U.S. PATENT DOCUMENTS

| | | | |
|---|---|---|---|
| 3,349,359 | 10/1967 | Morey | 219/545 |
| 3,385,959 | 5/1968 | Ames et al. | 219/549 |
| 3,627,988 | 12/1971 | Romanlee . | |
| 3,657,516 | 4/1972 | Fujihara | 219/549 |
| 3,774,299 | 11/1973 | Sato et al. | 29/611 |
| 3,935,422 | 1/1976 | Barnes et al. | 219/543 |
| 4,149,066 | 4/1979 | Niibe | 219/549 |
| 4,250,397 | 2/1981 | Gray et al. | 219/528 |
| 4,764,665 | 8/1988 | Orban et al. . | |
| 4,825,049 | 4/1989 | Rickborn | 219/545 |
| 4,983,814 | 1/1991 | Ohgushi et al. . | |
| 5,023,433 | 6/1991 | Gordon | 219/548 |
| 5,068,518 | 11/1991 | Yasuda | 219/549 |
| 5,298,722 | 3/1994 | Tanaka | 219/545 |

*Primary Examiner*—Sang Paik
*Attorney, Agent, or Firm*—Liniak, Berenato, Longacre & White

[57] ABSTRACT

A soft and flexible thin heating element made of electrically conductive carbon carrying fabric coated with a soft stabilizing material. The heating element is shaped by curing the soft stabilizing material and cutting the coated fabric into a desired pattern. The electrical contacts are attached to the ends of the heating element core, which are electrically connected in parallel or in series. The fabric heating element core is sealed to form a multi-layer assembly comprising of at least two electrically insulating layers which envelop each strip of the heating element core. A method of producing the soft and flexible heating element is also disclosed.

1 Claim, 4 Drawing Sheets

FABRIC HEATING ELEMENT AND METHOD OF MANUFACTURE

BACKGROUND OF THE INVENTION

1. Field of Invention

This invention relates to heating elements, and more particularly to heating elements which are soft, flexible, flat, strong, light and thin, and to their method of manufacture.

2. Description of the Prior Art

Heating elements have extremely wide applications in household items, construction, industrial processes, etc. Their physical characteristics, such as thickness, shape, size, strength, flexibility and other characteristics affect their usability in various applications.

Numerous types of thin and flexible heating elements have been proposed, for example U.S. Pat. No. 4,764,665 to Orbat et. al. This heating element, however, is made of a solid piece of fabric with metallized coating, it does not allow for flexibility in selection of desired power density and is not economical due to metallizing process. The '665 design is also not conducive to hermetic sealing through the heater areas which can cause a short circuit through puncture and admission of liquid. This element can't be used with higher temperatures due to the damage that would be caused to the metallized fabric.

Another prior art example is U.S. Pat. No. 4,538,054 to de la Dorwerth. However, the heating element of de la Dorwerth '054 suffers from the following drawbacks: its manufacturing is complex requiring weaving of metal or carbon fibers into non-conductive fabric in a strictly controlled pattern; the use of the metal wire can result in breakage due to folding and crushing and it affects softness, weight and flexibility of the finished heater; it can't be manufactured in various shapes, only a rectangular shape is available; only perimeter sealing is possible, which can result in a short circuit due to puncture and admission of a liquid; the method of interweaving of wires and fibers doesn't result in a strong heating element, the individual wires can easily shift adversely affecting; the fabric base of the heating element is flammable and may ignite as a result of a short circuit; it is not suitable for high temperature applications due to destruction of the insulating weaving fibers at temperatures exceeding 120° C.

U.S. Pat. No. 3,627,988 describes a method of assembling a surface heater based on carbon fibers consisting of attachment of continuous non-woven carbon fiber material to contact electrodes and to the shape forming layers of fabric by sewing with a thread. The disadvantages of this method are as follows: this method doesn't allow the flexibility of creating heating elements of various shapes and sizes; the manufacturing process is complex and produces hazardous dust during the sewing operation; application of pressure to the surface of the heating element, made of non-woven carbon fabric, significantly increases its electro-conductivity, which, in turn, changes its intended properties; after a period of use under the effect of mechanical forces the non-woven material tends to separate and to form localized lumps affecting usability and performance; this method produces a heater with significant thickness.

Further, attempts have been made to fabricate electrically heated systems from carbon fibers, yarns, and fabrics by coating the carbon material with a protective layer of elastomer or other materials to overcome carbon's extremely poor abrasion and kink resistance (Carbon Fibers for Electrically Heated Systems, by David Mangelsdorf, final report June 1974–May 1975, NTIS). It was found that the coating used in this method reduced the carbon material flexibility and increased the difficulty of making electrical attachments to it, and making electrically continuous seams. The poor flexibility of coated carbon fabric made this material unsuitable for small and complex assemblies, such as handware.

U.S. Pat. No. 4,149,066 to Niibe at. al describes a sheet-like thin flexible heater made with an electro-conductive paint on a sheet of fabric. This method has the following disadvantages: the paint has a cracking potential as a result of sharp folding, crushing or punching; the element is hermetically sealed only around its perimeter, therefore lacking adequate wear and moisture resistance; such an element can't be used with high temperatures due to destruction of the underlying fabric and thermal decomposition of the polymerized binder in the paint; the assembly has 7 layers resulting in loss of flexibility and lack of softness.

Additionally, a known method of achieving a flexible flat heating element is by surfacing threads of fabric with carbon particles and various polymers as disclosed in U.S. Pat. No. 4,983,814. The resulting heating elements have necessary electro-physical characteristics, but their manufacturing is complex and is ecologically unfriendly because of the use of organic solvents, such as diethylphormamide, methylethylketone and others. Furthermore, this method involves application of an electro-conductive layer only to the surface of threads of fabrics. This layer, electro-conductivity of which is achieved through surface contact of extremely small particles, is susceptible to damage due to external factors, such as friction, bending, etc.

The proposed patent seeks to alleviate the drawbacks of the prior art and describes the fabrication of a carbon carrying fabric heating element which is economical to manufacture; doesn't pose environmental hazards; results in a soft, flexible, flat, strong, thin, and light heating element, suitable for even small and complex assemblies, such as handware. A significant advantage of the proposed patent is that it provides for fabrication of heating elements of various shapes and sizes, with predetermined electrical characteristics; allows for a durable heater, resistant to kinks and abrasion, and whose electro-physical properties are unaffected by application of pressure, sharp folding, punches, small punctures, small cuts and crushing.

OBJECTS OF THE INVENTION

The first objective of the invention is to provide a significantly safe and reliable heating element which can function properly after it has been subjected to sharp folding, kicking, small punctures, punching or crushing, thereby solving problems associated with conventional flexible heating wires. In order to achieve the first objective, the electric heating element, of the present invention, is made of a carbon carrying conductive fabric which possesses the following characteristics: (a) high strength; (b) high strength-to-weight ratio; (c) high thermal and electrical conductivity; (d) very low coefficient of thermal expansion; (e) non-flammability; (f) softness. The proposed invention comprises continuous or electrically connected separate strips of carbon carrying fabric, which radiate a uniform heat over the entire heating surface, thus preventing occurrence of overheated spots.

A second objective of the invention is to provide maximum flexibility and softness of the heating element. In order to achieve the second objective, the electric heating element of the invention is made of a very thin (0.1 to 3 mm, but preferably within the range of 0.2–2.0 mm) woven or non-woven carbon carrying fabric, which is cut into continuous or electrically connected strips and patterned to have gaps between the strips. Furthermore, all the components of the multi-layer heating element assembly are thin, soft and flexible materials.

A third objective of the invention is to provide for the uniform distribution of heat without overheating and hot spots, thereby solving the problem of over insulation and energy efficiency. In order to achieve this objective, one side of the heating element includes a metallic foil or a metallized material to provide uniform heat distribution and heat reflection. A thin layer of such electro-conducting heat reflecting material is placed above the electro-insulating material prior to lamination to prevent direct electrical contact of metal with the conductive fabric. It is also preferable that the soft heating elements of the invention are made without thick cushioning insulation, which slows down the heat delivery to the surface of the heating apparatus.

A forth objective of the invention is to provide for ease in the variation of heating power density utilizing the same type of conductive fabric, thereby solving a problem of manufacturing various heating devices with different electric power density requirements. In order to achieve the forth objective, the carbon carrying conductive fabric is stabilized by impregnation with soft filling substances and then cut to desired patterns. The soft filling material can also be used to augment the electro-physical characteristics of the carbon carrying fabric.

A fifth objective of the invention is to provide a reliable and strong electrical contact of the conductive fabric with electrodes for electric power delivery, thereby solving a problem of providing a sufficient electrical contact between soft conductive fabric and metal electrodes during assembling of the heating element. In order to achieve the fifth objective, the contacts are made of thin metal foil, metallized polymer or thin rigid conductive electrodes which are attached to the ends of the carbon carrying fabric prior to lamination of insulating materials. The electrical contacts are glued to the carbon carrying fabric heating element core by the conductive adhesive and firmly attached to the fabric to provide a sufficient electrical conductivity. It is preferable that conductive adhesive is comprised of carbon/graphite or silver or nickel ingredients.

A sixth objective of the invention is to provide for ease of installation of the electric heating elements inside the heating devices, thereby solving a problem of complicated attachment of conventional heating wires over the desired working area of the flexible heating devices. In order to achieve the sixth objective, the insulated electric heating element is patterned and manufactured prior to installation to fit the whole desired area of the flexible heating device.

SUMMARY OF THE INVENTION

The present invention comprises a heating element which is flat, thin, flexible, soft, strong and light. It is also highly resistant to abrasion, punctures, cuts, punches, sharp folding and crushing. It can be manufactured in various shapes and sizes, and it can be designed for a wide range of parameters, such as input voltage, desired temperature range, desired power density, type of current (AC and DC) and method of electrical connection (parallel and series). A soft and flexible thin heating element made of electrically conductive carbon carrying fabric is impregnated with a soft filling material. The heating element is shaped by pressing, heat treating and cutting the fabric into a serpentine pattern. The electrodes are attached to the ends of the serpentine strips which are electrically connected in parallel or in series. The fabric heating element core is sealed to form a multi-layer assembly comprising of at least two electrically insulating layers which envelop each strip of the serpentine strips. The method of producing the soft and flexible heating element is also disclosed.

DETAILED DESCRIPTION OF THE INVENTION

Figure 1:
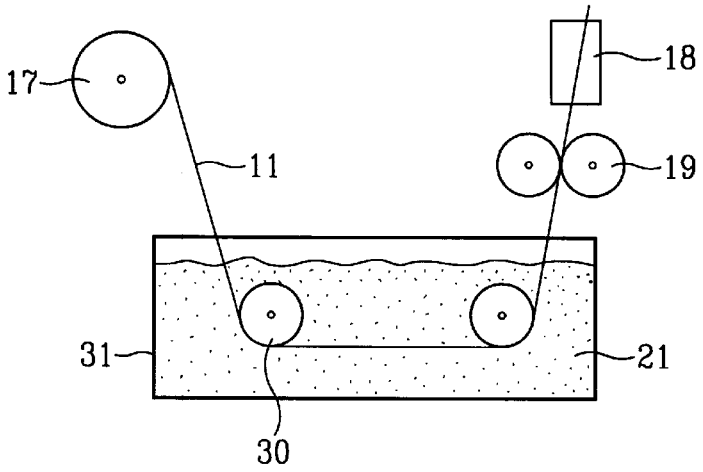
FIG. 1 is a schematic view of the process of manufacturing the carbon carrying fabric with the soft filling material according to the present invention.

The present invention is detailed in FIGS. 1 through 6. As shown in FIG. 1 a carbon carrying fabric basis (11) is unrolled from the spool (17), advanced through the driving rollers (30) and is coated in the impregnation basin (31) with a solution of soft filling material (21). The coating in the impregnation basin (31) can be successfully substituted by spraying of the solution of soft stabilizing material (21) or application of thin polymer film of the soft stabilizing material at least from one side of carbon carrying fabric (11). The terms soft filling material and soft stabilizing material are used interchangeably.

The excess soft filling material is than squeezed out by the rollers (19) with an adjustable pressure function; this allows for variation in the amount of the soft filling material left in the carbon carrying fabric depending on design parameters. The carbon carrying fabric (11) is then passed through the curing device (18) where it is subjected to heat and, if necessary, pressure to adequately set and cure the soft filling material (21).

The soft filling material acts as fabric stabilizer and enables cutting of the carbon carrying fabric into a desired shape. In addition it may be used to augment the electro-conductive characteristics of the base carbon carrying fabric (11). Therefore, the soft filling material (21) can include conductive particles like graphite, carbon black, or other metal carrying compounds. It is preferable to use nonvolatile oligomeric or polymeric compounds like starch, polyethylene, carboxymethylcellulose, polyurethane as soft filling materials (21).

Figure 2:
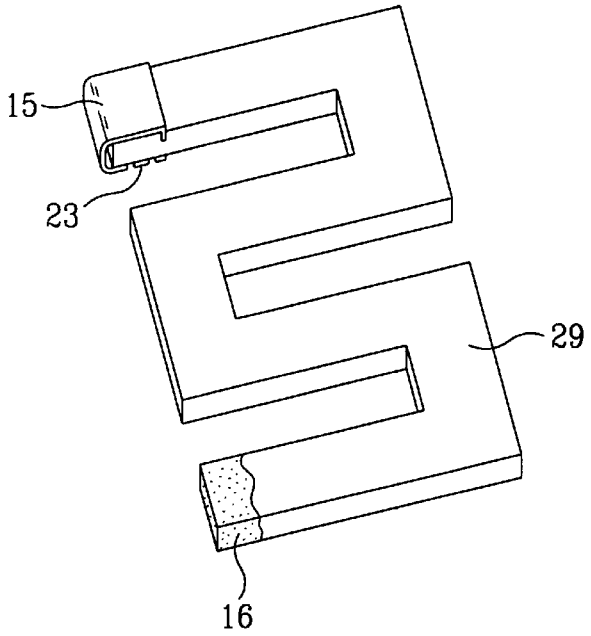
FIG. 2 is a perspective view of a heating element according to the preferred embodiment of the present invention.

As shown in FIG. 2, a serpentine shape heating element core (29) is cut out from the stabilized carbon fabric (11). It is preferable that the strips of the carbon fabric serpentine core (29) have an even width. The ends to which the electrodes shall be attached are cleaned of non-conductive material and an optional conductive adhesive or conducting filling material (16) is applied to them. Thin contact electrodes (15) are then attached to the ends of the heating element core (29).

Figure 3:
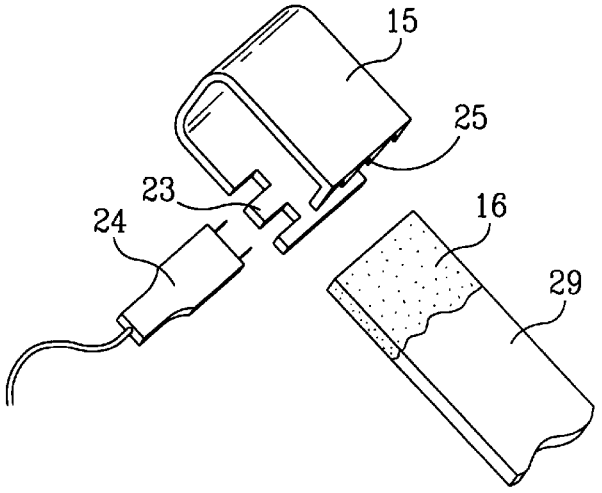
FIG. 3 is an exploded view of the connection of the fabric, contact electrodes, and power cord.

As shown in FIG. 3, the optional holding teeth (25) may be used to achieve a better contact between the fabric and the electrodes. A power cord (20), having a plug (26), is then attached to the contact electrodes (15) utilizing male (23) and female (24) connectors or other known methods which provide sufficient electrical contact.

Figure 4:
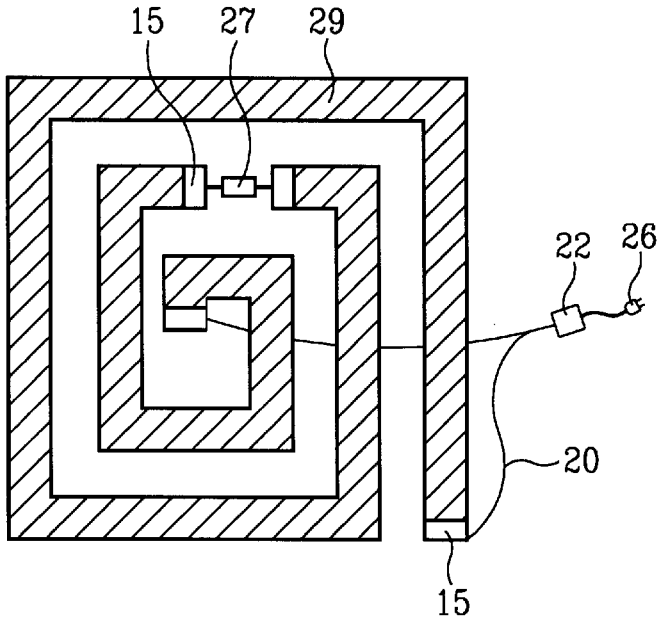
FIG. 4 is a plan view of heating elements connected in series according to an embodiment of the present invention.
Figure 5A:
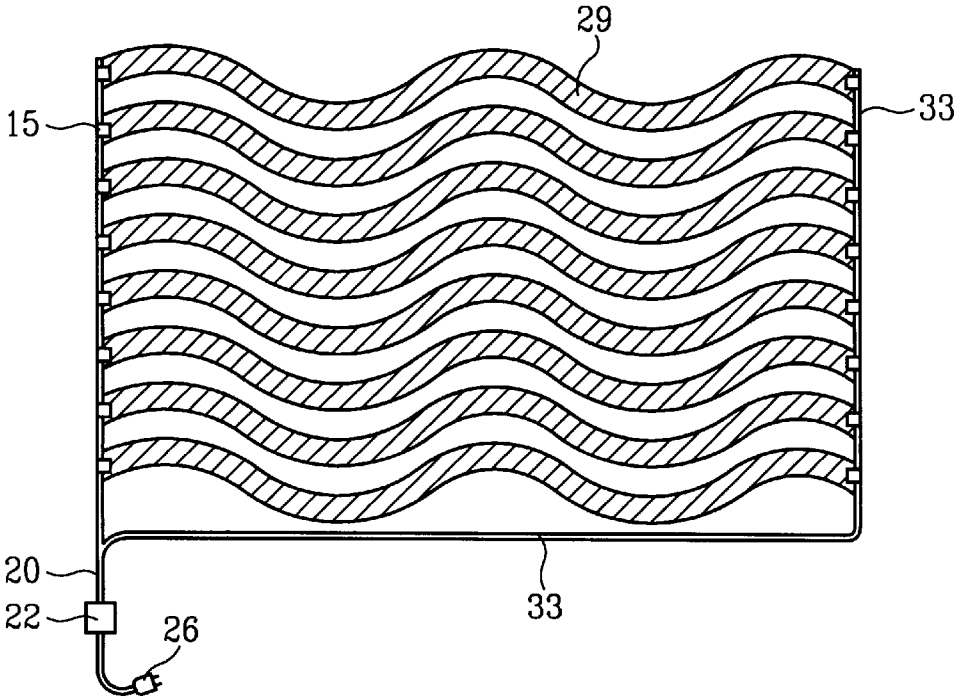
FIGS. 5*a* and 5*b* are plan views of heating elements connected in parallel according to another embodiment of the present invention.
Figure 5B:
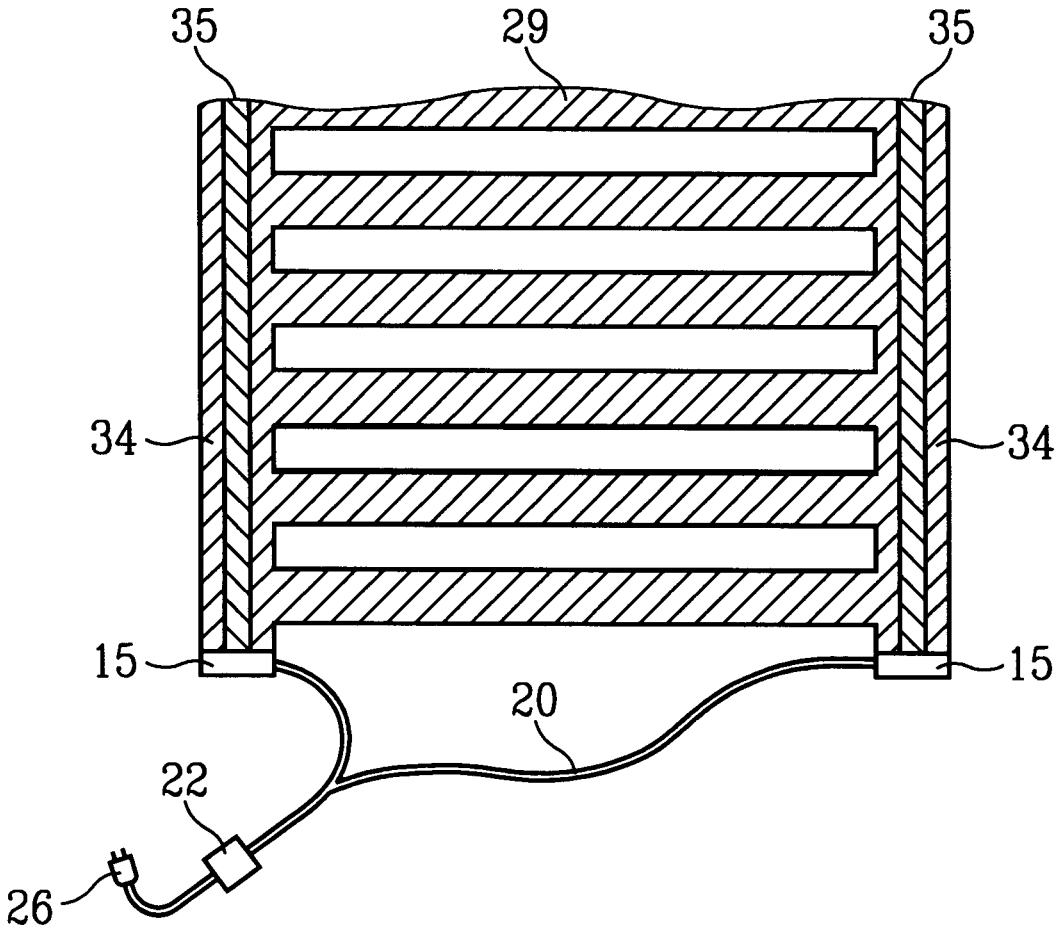

As shown in FIG. 4 and FIG. 5, the electrical connection may be made in series or in parallel. An optional heat regulating thermostat (27) and power output adjustment device (22), may be installed, if required, by a listing agency or a design. The most appropriate patterns which allow efficient and economical trimming of the carbon carrying fabric (11) are zigzag and spiral shapes. The parallel connection can be accomplished either by connecting separate strips of the carbon carrying fabric (11) to a conductive bus bar (33) as shown in FIG. 5*a*, or by cutting the assembly in such a way that the carbon carrying fabric bus strips (34) located at opposite ends of the heating strips are continuous to the heating strips without a break in the carbon carrying fabric material (11) from which they were cut out. (FIG. 5*b*) In order to provide for high electrical conductivity of the bus strips (34), which is necessary to assure a uniform current distribution through all strips of the heating core (29), the bus strips (34) can be augmented by one or combination of the following methods: affixing highly electro-conductive flexible strips (35) to at least one side of each bus strip (34); interweaving or sewing highly electro-conductive wires through each bus bar (34); or impregnating the bus strips (34) with a highly electro-conductive substance, including but not limited to graphite.

Figure 6:
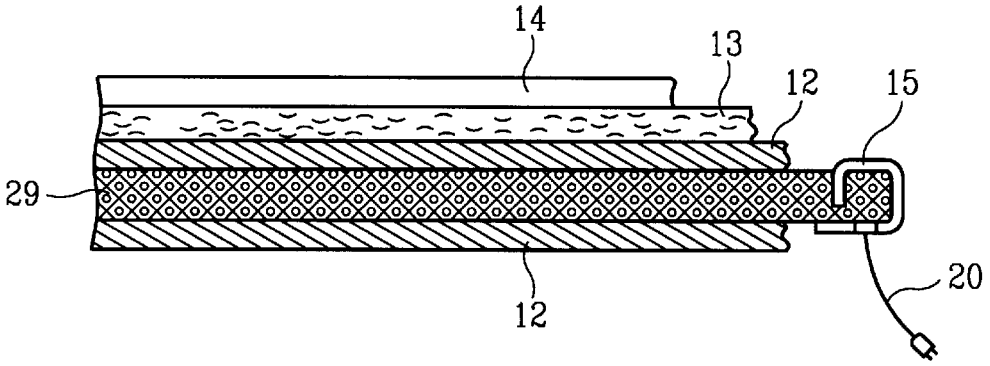
FIG. 6 is a cross section view of a laminated heating element according to an alternate embodiment of the present invention.

As shown in FIG. 6, the assembly of heating element core (29), contact electrode (15) and the power cord (20) is then laminated between at least two layers of electro-insulating material (12) with an optional heat reflective layer (13) and a protective layer (14) adhered to heat reflective layer (13). The electro-insulating materials (12) envelop each strip of the heating element fabric core (29), hermetically sealing the gaps between said strips.

Figure 7:
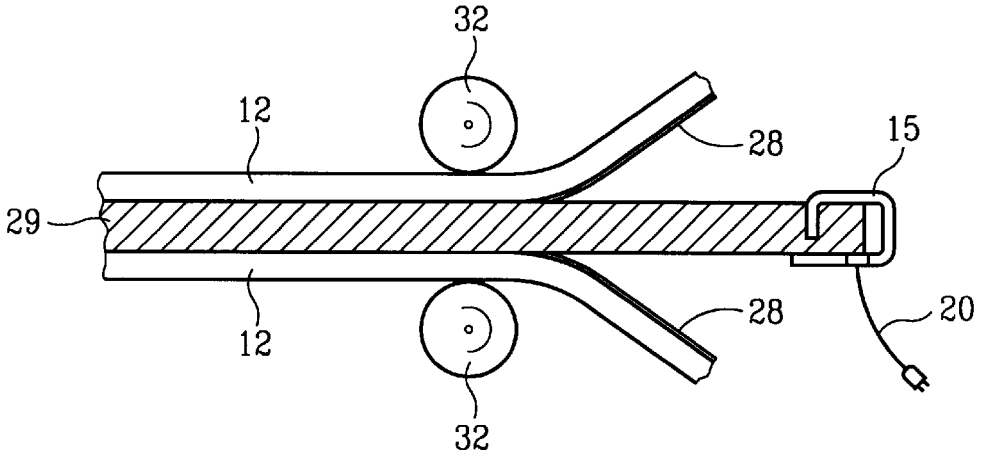
FIG. 7 is sectional view of a process of applying insulation to a heating element according to an alternate embodiment of the present invention.
Figure 8:
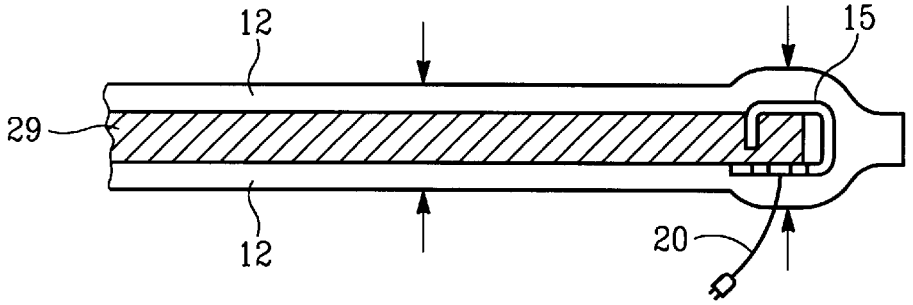
FIG. 8 is a sectional view of an insulated heating element according to an alternate embodiment of the present invention.

As shown in FIG. 7 and FIG. 8, the complete heating element assembly is then sealed by a pressure device (32) with or without application of heat. The electro-insulating materials (12) envelop each strip of the heating element fabric core (29) sealing the gaps between said strips. A low temperature sealing consists of application of electro-insulating materials (12) having heat resistant adhesive (28) at least on one side of electro-insulating materials (12) facing the heating element fabric core (29). A high temperature sealing consists of heating of electro-insulating materials (12) which results in their fusing in the gaps between the strips of the heating element fabric core (29).

A flexible-in-all-directions thin heating element can be utilized for all varieties of commercial and industrial heaters utilizing direct or alternative current. The main advantages of the heating element are the high reliability and safety which are provided by the tightly sealed soft and durable conductive fabric.

Furthermore, the heating element has additional advantages in that the thin fabric:

enables manufacturing of the thin, soft and uniform heaters without installation of disturbing conventional heater wires;

provides high durability of the heating appliances which can withstand sharp folding, punches, punctures, small cuts and compression without decreasing of electrical operational capabilities;

provides high tear and wear resistance owing to: (a) high strength of the conductive fabric, (b) enveloping around all of the fabric serpentine pattern with the polymer insulating material;

provides high moisture resistance owing to: (a) impregnating of the soft filling material which prevents or significantly slows down penetration of the moisture through the fabric core, (b) sealing of the gaps between the fabric core serpentine by the polymer insulating materials;

provides for manufacturing of corrosion and erosion resistant heating element owing to: (a) high chemical inertness of the carbon carrying fabric and (b) hermetic polymer insulation of the whole heating element including connection electrodes and temperature control devices, in utilization in chemically aggressive industrial or marine environments;

offers versatility of variation of the electrical conductivity of the fabric core owing to: (a) cutting of desired serpentine pattern of the conductive fabric, (b) impregnation with the soft filling material having different amount of conductive ingredient, (c) carbon carrying fabric having different amount of conductive fibers per unit volume [Example: different type and density of weaving], (d) carbon carrying fabric having different level of carbonizing of the fibers;

provides for saving of electric power consumption owing to: (a) installation of heat reflective layer and (b) possibility of placing the heat element with less cushioning and insulation closer to the human body or to the heated object;

allows for manufacturing of heating element with electrical connection of electrically conductive strips in parallel or in series;

overcomes the problem of overheated spots owing to (a) high heat radiating surface area of the fabric core, (b) uniform heat distribution by the heat reflective and heat conductive layer preventing the possibility of skin burns or destruction of the insulating polymer layers;

provides for extremely low thermal expansion of the heating element owing to the nature of the carbon carrying fabric. This feature is extremely important for construction applications (Example:—concrete) or for multi-layer insulation with different thermal expansion properties;

consists of a non combustible conductive fabric which does not cause arcing while being cut or punctured during electrical operation;

offers high degree of flexibility and/or softness of the heating appliances depending on the type and thickness of insulation; and provides technological simplicity of manufacturing and assembling of said heating element.

The process of manufacturing of the insulated heating element can be fully automated, it utilizes the commercially available non toxic and inexpensive products. The insulated fabric core can be manufactured in rolls with subsequent cutting to desired sizes and further attachment of electric power cords.

The aforementioned description comprises different embodiments which should not be construed as limiting the scope of the invention but, as merely providing illustrations of some of the presently preferred embodiments of the invention. Additional contemplated embodiments include: (a) the conductive fabric can include other electrically conductive materials other than carbon, such as electroplated copper, nickel or tin containing coatings on the surface of the carbon carrying fibers; (b) the electrically conductive fabric can consist of ceramic fibers, such as alumina, silica, zirconia, chromia, magnesium, calcia or combination thereof, coated or impregnated with electrically conductive material such as carbon; (c) the soft filling material can consist of different oligomeric or polymeric compounds, such as polyurethane, polyvinyl-containing products, etc.; (d) the conductive fabric can be cut out into separate strips and subsequently electrically connected to each other in a serpentine form or other desired patterns, including ordinary straight or "U" shaped strips; (e) the electric power cord can be attached to the conductive fabric without electrodes by directly connecting of the cord by conductive adhesive, conductive paint, conductive polymer, etc.; (f) the conductive fabric heating element can be electrically insulated by other soft non conductive fabrics by sewing, gluing, fusing etc., forming a soft multi-layer assembly; (g) the conductive fabric core of the heating element can be electrically insulated by rigid non-conductive materials like ceramics, concrete, thick plastic, wood, etc.; (h) the conductive fabric heating element can be assembled in combination with other types of known flexible heating elements like heating wires.

While the foregoing invention has been shown and described with reference to a number of preferred embodiments, it will be understood by those possessing skill in the art that various changes and modifications may be made without departing from the spirit and scope of the invention.

I claim:

1. A method of manufacturing a heating element having a durable construction for incorporation into a plurality of articles, said method comprising the steps of:

coating woven carbon containing fabric with a soft stabilizing material;

curing said soft material so as to stabilize said coated fabric to prevent fraying after cutting;

cutting a heating element core of predetermined shape out of said coated fabric so as to create at least one gap between portions of said fabric;

attaching conductive means for introducing an electric current to the ends of said heating element core; and insulating said heating element by laminating said heating element between at least two layers of insulating material so as to envelop said heating element core and said conductive means, provided that said layers of insulating material are fused together through said at least one gap in said heating element core, wherein said coated fabric is pressed by advancing said coated fabric through a pressing device having at least one roller and having an adjustable pressure function to control the amount of stabilizing material in the coating.

* * * * *